US010132202B2

(12) United States Patent
Mann et al.

(10) Patent No.: US 10,132,202 B2
(45) Date of Patent: Nov. 20, 2018

(54) ADJUSTABLE CAMSHAFT

(71) Applicant: THYSSENKRUPP PRESTA TECCENTER AG, Eschen (LI)

(72) Inventors: Bernd Mann, Zschopau (DE); Uwe Dietel, Lichtentanne (DE); Michael Kunz, Chemnitz (DE); Jürgen Meusel, Dittmannsdorf (DE); Martin Lehmann, Mittelndorf (DE)

(73) Assignee: THYSSENKRUPP PRESTA TECCENTER AG, Eschen (LI)

( * ) Notice: Subject to any disclaimer, the term of this patent is extended or adjusted under 35 U.S.C. 154(b) by 0 days.

(21) Appl. No.: 14/901,158

(22) PCT Filed: Jun. 24, 2014

(86) PCT No.: PCT/EP2014/001709
§ 371 (c)(1),
(2) Date: Dec. 28, 2015

(87) PCT Pub. No.: WO2014/206552
PCT Pub. Date: Dec. 31, 2014

(65) Prior Publication Data

US 2016/0138434 A1 May 19, 2016

(30) Foreign Application Priority Data

Jun. 27, 2013 (DE) ..... 10 2013 106 746

(51) Int. Cl.
*F01L 1/047* (2006.01)

(52) U.S. Cl.
CPC ..... *F01L 1/047* (2013.01); *F01L 2001/0473* (2013.01); *F01L 2810/02* (2013.01)

(58) Field of Classification Search
CPC ..... F01L 1/047; F01L 2001/0471; F01L 2001/0473; F01L 1/344; F01L 2810/02;
(Continued)

(56) References Cited

U.S. PATENT DOCUMENTS 4,777,842 A * 10/1988 Yamada ..... F01L 1/0532 123/90.27
5,072,092 A * 12/1991 Richter ..... C21D 9/14 219/121.72

(Continued)

FOREIGN PATENT DOCUMENTS

CN 1942657 A 4/2007
CN 101273185 A 9/2008

(Continued)

OTHER PUBLICATIONS

German Language International Search Report for International patent application No. PCT/EP2014/001709; dated Oct. 8, 2014.

(Continued)

*Primary Examiner* — Phutthiwat Wongwian
*Assistant Examiner* — Loren Edwards
(74) *Attorney, Agent, or Firm* — Lathrop Gage, L.L.P.

(57) ABSTRACT

An adjustable camshaft can be used in valve drives of internal combustion engines, amongst other places. The adjustable camshaft may include an outer shaft and an inner shaft that is concentric with and rotatably supported in the outer shaft. A cam having a cam bore may be rotatably supported on an outer surface of the outer shaft so as to form a slide bearing gap between the cam and the outer shaft. The cam may be rotatably-fixed to the inner shaft so that the inner shaft and the cam rotate with one another. Furthermore, the adjustable camshaft may include an oil channeling groove disposed beneath the cam in the outer surface of the outer shaft. In many cases, at least one side of the oil channeling groove may be exposed such that it extends beyond the slide bearing gap and the cam.

20 Claims, 2 Drawing Sheets

(58) Field of Classification Search
CPC .. F16C 33/00; F16C 33/6677; F16C 33/1055; F16C 33/106
USPC ..... 123/90.15, 90.17, 90.33
See application file for complete search history.

(56) References Cited

U.S. PATENT DOCUMENTS

| | | | | |
|---|---|---|---|---|
| 6,056,442 | A * | 5/2000 | Ono | F01L 1/181 384/286 |
| 8,495,980 | B2 * | 7/2013 | Scherzinger | F01L 1/047 123/90.17 |
| 2007/0240657 | A1 | 10/2007 | Schneider | |
| 2008/0257104 | A1 | 10/2008 | Lancefield | |
| 2008/0257290 | A1 | 10/2008 | Lettmann et al. | |
| 2009/0229550 | A1 | 9/2009 | Clever et al. | |
| 2011/0120401 | A1 | 5/2011 | Scherzinger | |
| 2012/0160197 | A1 | 6/2012 | Matsunaga et al. | |

FOREIGN PATENT DOCUMENTS

| | | | |
|---|---|---|---|
| CN | 102046930 | A | 5/2011 |
| DE | 36 02 477 | A1 | 7/1986 |
| DE | 10 2005 014 680 | A1 | 8/2006 |
| DE | 10 2009 012 143 | A1 | 10/2009 |
| DE | 10 2012 103 594 | A1 | 10/2013 |
| GB | 2 431 977 | A | 5/2007 |
| JP | 2008 208755 | A | 9/2008 |
| WO | 2012090300 | A1 | 7/2012 |

OTHER PUBLICATIONS

English translation of International Search Report for International patent application No. PCT/EP2014/001709; dated Oct. 8, 2014.
English translation of the abstract of JP 2008 208755 A.
English translation of the abstract of DE 10 2012 103 594 A1.
Decker, Karl-Heinz: Maschinenelemente. 8th edition; Publisher: Carl Hanser-Verlag: Munich, Vienna, 1982. pp. 288, 289. ISBN 3-446-13558-8.
Japanese Application No. 2016-522315, Notice of Allowance, dated Mar. 19, 2018, 4 pages.

* cited by examiner

ADJUSTABLE CAMSHAFT

CROSS REFERENCE TO RELATED APPLICATIONS

This application is a U.S. National Stage Entry of International Patent Application Serial Number PCT/EP2014/001709, filed Jun. 24, 2014, which claims priority to German Patent Application No. DE 102013106746.8 filed Jun. 27, 2013, the entire contents all of which are incorporated herein by reference.

FIELD

The present disclosure relates to adjustable camshafts and, more particularly, to adjustable camshafts for valve gears of internal combustion engines.

BACKGROUND

Adjustable camshafts for the valve gear of an internal combustion engine having an outer shaft, on which a cam element is mounted and which is connected in a rotationally fixed manner to an inner shaft, which extends through the outer shaft, serve for variable control of the inlet valves and exhaust valves of the internal combustion engine. Further cam elements are mounted on the outer shaft in a rotationally fixed manner, and if the phase position of the inner shaft is adjusted relative to the phase position of the outer shaft, the phase position of the cam elements which are rotatably supported on the outer shaft, forming a slide bearing gap, also changes relative to the phase position of the cam elements which are rigidly arranged on the outer shaft. The nested shafts rotate about a common axis of rotation in the cylinder head of the internal combustion engine and can be adjusted relative to one another in their phase position by a control element. The cam elements interact with the valves of the internal combustion engine either directly or via rocker arms, and control forces, which have to be absorbed via the slide bearing gap of the rotatable support of the cam elements on the outer shaft, act on the cam elements. It has become apparent here that in the event of a deficient lubricating oil supply to the slide bearing gap between the inner surface of the cam elements and the outer surface of the outer shaft this may result in wear, which is always something to be avoided.

The post-published patent application DE 10 2012 103 594 A1 shows an adjustable camshaft for the valve gear of an internal combustion engine, having an outer shaft and an inner shaft rotatably mounted in the outer shaft. Cam elements are rotatably supported on the outer surface, forming a slide bearing gap, and are connected to the inner shaft by a bolt in a rotationally fixed manner. In order to transport lubricating oil from the installed surroundings of the camshaft into the slide bearing gap, it is proposed to introduce at least one oil-retaining bore into the cam element, so that splash oil can be fed from the installed surroundings of the camshaft through the oil-retaining bore into the slide bearing gap between the outer shaft and the cam element by the rotation of the camshaft. Here the oil-retaining bore is situated in the cam element, which has disadvantages in the machining process. In particular, the introduction of an oil channeling groove into the inner surface of the cam bore of the cam element is costly, and it has become apparent that owing to the centrifugal forces during rotation of the camshaft the lubricating oil largely remains in the oil channeling groove, so that it is desirable to improve the passage of the lubricating oil from the oil channeling groove into the slide bearing gap.

DETAILED DESCRIPTION

Figure 1:
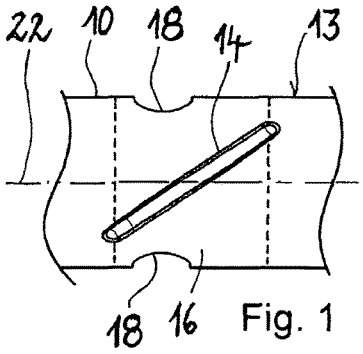
FIG. 1 is an enlarged view of an example outer shaft of an example adjustable camshaft having an example oil channeling groove in its outer surface.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

The object of the invention is to improve the supply of lubricating oil to the slide bearing gap between a cam element and an outer shaft of an adjustable camshaft, particularly in order to substantially avoid operating states with deficient lubrication of the slide bearing gap.

In many cases, this objective may be accomplished by a camshaft having an outer shaft and an inner shaft running concentrically in the outer shaft and rotatably mounted therein, wherein at least one cam element is rotatably supported on the outer surface of the outer shaft forming a slide bearing gap, and wherein the cam element is connected to the inner shaft in a rotationally fixed manner.

The invention embraces the technical teaching that at least one oil channeling groove is made in the outer surface of the outer shaft in a position and with an axial length such that the oil channeling groove is formed at least over the axial width of the slide bearing gap and is led out of the slide bearing gap with an exposed groove portion on at least one side of the cam element. Those having ordinary skill in the art will understand that depending on the frame of reference, terms such as axial 'width' of the slide bearing gap may also be referred to as an axial 'length' occupied by the slide bearing gap.

The inventive introduction of at least one oil channeling groove into the outer surface of the outer shaft creates the facility for ducting oil (in the present usage also referred to as lubricating oil), which can enter the oil channeling groove through the exposed groove portion, via the latter into the slide bearing gap, and the passage of lubricating oil into the slide bearing gap between the outer surface of the outer shaft and the inner surface of the cam element is improved.

The slide bearing gap is such that the cam element on the outer surface of the outer shaft is able to perform a movement in the order of a few microns, in that the diameter of the outer shaft is slightly smaller than the diameter of the cam bore in the cam element. The interaction of the cam element with a follower for the actuation of a valve gives rise to a periodically varying impingement on the cam element, thereby producing a rise and fall of the inner surface of the cam bore on the outer surface of the outer shaft. As a result, the micro-gap, which prevails in the slide bearing gap, periodically increases and diminishes, producing a pumping effect. It has become apparent here, particularly in operative connection with an oil channeling groove, which is made in the outer surface of the outer shaft, that this pumping effect is capable of producing an especially enhanced introduction of lubricating oil into the slide bearing gap. As a result, the pumping effect in interaction with the inventive oil channeling groove ensures a permanent lubricating oil supply to the slide bearing gap, even in extreme operating conditions but especially also under a very slow rotation of the camshaft, and surface wear of the outer surface of the outer shaft and/or the inner surface in the cam bore of the cam element is effectively prevented.

According to one possible advantageous embodiment for the formation of the inventive oil channeling grooves in the outer surface of the outer shaft, the oil channeling grooves may run in the direction in which the camshaft extends. This affords an especially simple technical production of the oil channeling grooves, for example by means a single-axis milling operation. The oil channeling groove may run in a straight line in the outer surface of the outer shaft, wherein one or more oil channeling grooves extending in the direction of the camshaft can be introduced for each seating point at which a cam element is arranged on the outer shaft. The direction in which the oil channeling grooves extend here runs parallel to the axis of rotation of the adjustable camshaft.

According to a further advantageous exemplary embodiment, at least the one oil channeling groove having an axial extent component and an extent component running in a circumferential direction may run helically in the outer surface of the outer shaft. The helical course of the oil channeling groove assists the ingress of lubricating oil via the exposed groove portion of the oil channeling groove, which protrudes from the slide bearing gap between the outer shaft and the cam element, the ingress of lubricating oil into the oil channeling groove being assisted by the rotation the camshaft. Due to the rotation of the camshaft, a quantity of oil adhering to the outer surface of the outer shaft runs approximately in a circumferential direction along over the outer surface and when the lubricating oil, for example in droplet form or as a migrating oil film, encounters the exposed groove portion, the entry of the lubricating oil into the oil groove is assisted by the helical course of the oil channeling groove. Consequently, the helical course generates a scoop effect, so that an effect transporting the lubricating oil into the oil channeling groove is assisted by the angular momentum imparted by the helical course in the oil channeling groove.

It is particularly advantageous for a first oil channeling groove having a first direction of helical rotation and at least a second oil channeling groove having a second direction of helical rotation opposed to the first direction of helical rotation to be formed at a seating point of a cam element on the outer shaft. Oil channeling grooves running helically in opposite directions in the outer surface of the outer shaft afford the advantage that lubricating oil can get into a first oil channeling groove via an exposed groove portion on a first side of the cam element, and a further quantity of oil is equally able to enter the further oil channeling groove via a further exposed groove portion on the opposite side of the cam element. Consequently, lubricating oil also flows in opposite directions through the oil channeling grooves running in opposite directions.

It is furthermore advantageous for at least the one oil channeling groove to be led out of the slide bearing gap with an exposed groove portion on each of the two sides of the cam element. The oil channeling groove thereby not only forms a lubricating oil reservoir formed in the slide bearing gap but can also carry a flow of lubricating oil through the oil channeling groove, in that the lubricating oil on a first side of the cam element runs into the oil channeling groove via a first exposed groove portion and on the opposite side of the cam element is able to leave the oil channeling groove again via a further exposed groove portion. Here some of the lubricating oil flowing through the oil channeling groove may pass into the slide bearing gap assisted, in particular, by the pumping effect. As a result, a permanent replacement of lubricating oil in the slide bearing gap is most advantageously achieved.

A bolt, which extends transversely through the inner shaft and through at least one bolt aperture made in the outer shaft, may be provided for rotationally fixed connection of the cam element to the inner shaft. Here the bolt may be seated with at least one of its ends in the cam element, thereby producing the rotationally fixed connection between the inner shaft and the cam element. At least the one oil groove may also run at a distance from the arrangement of the bolt aperture in the outer shaft. This prevents lubricating oil escaping from the oil channeling groove into the bolt aperture, with the further advantage that lubricating oil can likewise pass through the bolt aperture into the slide bearing gap, so that further areas of the slide bearing gap at a distance from the bolt aperture can additionally be supplied with lubricating oil though the oil channeling grooves.

Particularly critical areas, that is to say high load stress areas, can be supplied through the oil channeling grooves without crossing at least the one bolt aperture in the outer shaft. Consequently, the lubricating oil cannot flow out through the apertures for the bolts.

According to one advantageous embodiment of the adjustable camshaft, the cam elements may comprise at least one cam flange, wherein the axial width of the slide bearing gap is also determined by the width of the cam flange. The slide bearing gap therefore extends under the actual cam element and away under the area of the cam flange, so that the oil channeling grooves can also have a corresponding length over the actual cam element and away from the cam flange. Here the bolt for connecting the cam element to the inner shaft may be seated in the cam flange, so that the cam element has a rotationally fixed connection to the inner shaft by way of the cam flange and the bolt.

It is furthermore advantageous for the oil channeling groove to have a cross section varying over the length, especially in such a way that the oil channeling groove tapers from the exposed groove portion into the slide bearing gap, for example. Larger dimensions in the area of the exposed groove portion assist the entry of lubricating oil into the groove portion, the taper of the oil channeling groove assisting the escape of the lubricating oil from the oil channeling groove into the slide bearing gap through the area of the oil channeling groove running inwards into the slide bearing gap.

According to a further advantageous measure for improving the lubricating oil supply to the slide bearing gap between the outer surface of the outer shaft and the inner surface in the cam bore, a surface texturing, which in particular may be such that the load-carrying capacity of a lubricating film forming between the outer surface of the outer shaft and the inner surface in the cam bore is improved, may be provided on the outer surface and/or on the inner surface. For example, the surface texturing may be produced in the outer surface of the outer shaft and/or in the inner surface in the cam bore by a laser beam machining process, a honing process, an electron beam process or by an etching process. The surface texturing may comprise channels or flutes in the surface, which are formed running axially, circumferentially, spirally or in reticulated form, for example, in relation to the longitudinal extent of the camshaft.

Improving the load-carrying capacity of a lubricating film forming between the surfaces means that the surface texturing provides micro lubricating pockets, which the lubricating oil enters and which holds a small quantity of lubricating oil ready for passage into the slide bearing gap. A breakdown of the lubricating film with the formation of mixed friction is thereby effectively delayed. For example, the inner surface in the cam bore may have a cross-honed ground surface, as is also known from the cylinder lining of a reciprocating piston engine. The cross-honed ground surface may similarly be applied to the outer surface of the outer shaft, producing a reticulated surface texturing.

Moreover, the surface of the camshaft may be hardened, so that the peaks of the surface texturing in contact with the cam elements are not abraded. This furthermore serves to prevent or reduce wearing-in of the cam elements on the outer shaft over the entire seating point area or due to edge carrier effects.

Figure 2:
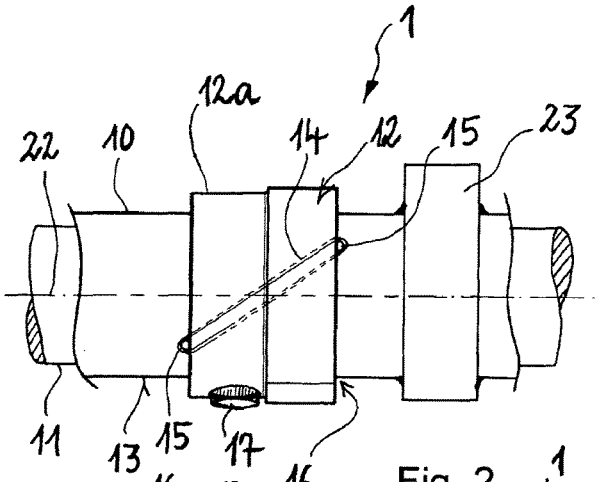
FIG. 2 is an enlarged view of an example adjustable camshaft having an example cam and an example channeling groove in an area of a seating point of the cam.

FIGS. 1 and 2 show a first exemplary embodiment of an adjustable camshaft 1, FIG. 1 showing a detail of an outer shaft 10, and FIG. 2 representing a detail of a camshaft 1 having an outer shaft 10 according to FIG. 1. The outer shaft 10 is formed as a hollow shaft, and an inner shaft 11 extends through the outer shaft 10 and is rotatable independently of the outer shaft 10 about a common camshaft axis 22. Here the inner shaft 11 is rotatably supported in the outer shaft 10. A cam element 23 is rigidly mounted on the outer shaft 10, and the cam element 23 may be welded to the outer shaft 10, for example, or fixed on an expanded diameter by means of a press fit. The cam element 23 thereby rotates in phase with the outer shaft 10.

In the area of a seating point 16 a further cam element 12 is rotatably mounted on the outer surface 13 of the outer shaft 10, forming a slide bearing gap. The cam element 12 comprises a cam flange 12*a*, and the cam element 12 is connected to the inner shaft 11 in a rotationally fixed manner by means of a bolt 17. In order that the inner shaft 11 can still rotate in relation to the outer shaft 10 about the camshaft axis 22, despite the bolt 17 fed through the outer shaft 10, bolt apertures 18, which extend over an angular range in the circumferential direction, are provided in the outer shaft 10, so that the cam element 12 can be turned by a rotation of the inner shaft 11 in relation to the phase position of the cam element 23, which is rigidly arranged on the outer shaft 10. Valve timings of an internal combustion engine, for example timings for inlet valves and exhaust valves, can thereby be adjusted separately from one another.

An oil channeling groove 14, which has a helical course with an axial extent component in the direction towards the camshaft axis 22 and an extent component running in a circumferential direction, is shown in the outer shaft 10. The width of the seating point 16 in the direction towards the camshaft axis 22 is indicated by dashed lines, and the width of the seating point 16 here corresponds to the width of the slide bearing gap between the outer surface 13 of the outer shaft 10 and the cam element 12. This shows that the oil channeling groove 14 extends away over the entire width of the seating point 16, and runs beyond this with exposed groove portions 15, as shown in FIG. 2. As a result, oil adhering to the outer surface 13 of the outer shaft 10 can enter the oil channeling groove 14 via the exposed groove portions 15, one exposed groove portion 15 possibly serving for entry and a further exposed groove portion 15 for escape of the lubricating oil into/from the oil channeling groove 14, depending on the direction of rotation of the camshaft 1.

Figure 3:
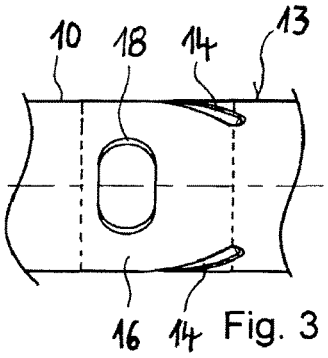
FIG. 3 is an enlarged view of an example outer shaft having two example oil channeling grooves disposed in an outer surface of the outer shaft and oriented in opposite directions.
Figure 4:
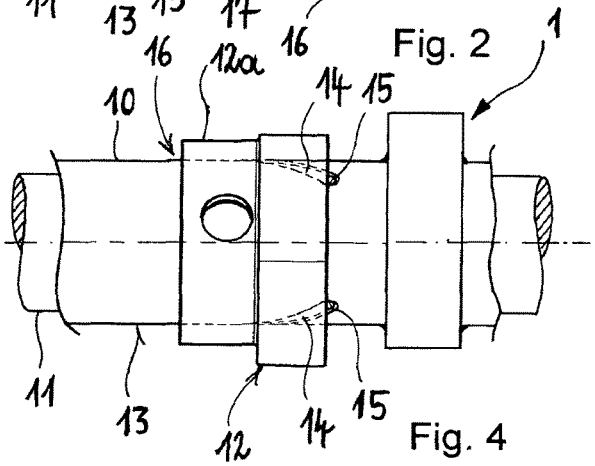
FIG. 4 is an enlarged view of an example camshaft having a cam, wherein two example oil channeling grooves, as shown in FIG. 3, are disposed in the outer surface of the outer shaft in an area of a seating point of the cam.

FIGS. 3 and 4 show a further exemplary embodiment of a camshaft 1. FIG. 3 shows a portion of an outer shaft 10 having two oil channeling grooves 14, the outer shaft 10 having the oil channeling grooves 14 likewise being represented in the detail view of the camshaft 1 according to FIG. 4. The oil channeling grooves 14 made in the outer surface 13 of the outer shaft 10 have a helical course running in opposite directions, and exposed groove portions 15 continue laterally over the side area of the cam element 12 on the outer shaft 10. Through rotation of the camshaft 1, lubricating oil can enter both the first oil channeling groove 14 and the second oil channeling groove 14 via the exposed groove portions 15, entry ensuing via those exposed groove portions 15 which point in the direction of rotation of the camshaft 1 about the camshaft axis 22, relative to the direction of helical rotation. Use is thereby made of a scoop effect, and lubricating oil is able to run through the oil channeling grooves 14. At the same time, the lubricating oil from the oil channeling groove 14 can pass into the slide bearing gap over the width of the seating point 16, in order to supply the slide bearing between the cam element 12 and outer shaft 10 with lubricating oil.

Figure 5:
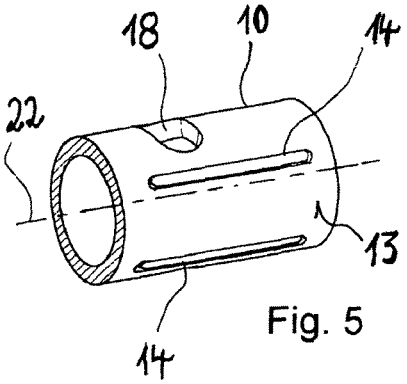
FIG. 5 is a perspective view of a segment of an example outer shaft that has two example oil channeling grooves.
Figure 6:
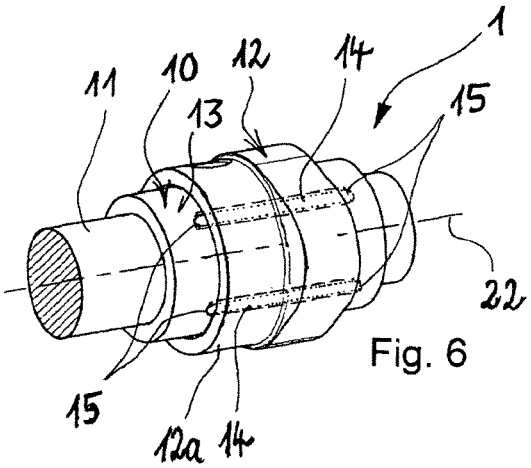
FIG. 6 is a perspective view of an example camshaft having an example outer shaft, an example inner shaft, an example cam, and two example oil channeling grooves extending in a longitudinal direction along an outer surface of the outer shaft.

FIGS. 5 and 6, each in a perspective view, show a further exemplary embodiment of oil channeling grooves 14 in the outer surface 13 of the outer shaft 10, and the oil channeling grooves 14 run in the longitudinal direction of the camshaft 1 parallel to the camshaft axis 22. FIG. 5 shows that the bolt aperture 18 made in the outer shaft 10 is arranged at a distance from the arrangement of the oil channeling grooves 14, so that no lubricating oil is able to enter the oil channeling groove 14 directly from the bolt aperture 18; equally no lubricating oil can pass directly from the oil channeling groove 14 into the bolt aperture 18. The ends of the oil channeling grooves 14 open out in exposed groove portions 15, which run out laterally from the slide bearing gap between the cam element 12 and the outer shaft 10, in order to allow lubricating oil to pass into the oil channeling grooves 14 via the exposed groove portions 15.

The representations show a camshaft 1, as can be mounted via slide bearings in the cylinder head of an internal combustion engine. The slide bearings (not shown) may support the camshaft 1 by way of the outer shaft 10, the slide bearings possibly being supplied with lubricating oil via oil ducts in the static bearing shells. Here the lubricating oil may escape laterally to the slide bearing points, and it may furthermore prove advantageous for the purposes of the present invention to arrange the slide bearings adjacent to the cam elements 12 connected to the inner shaft 11 in a rotationally fixed manner, so that the area of the outer surface 13 of the outer shaft 10, up to which the exposed groove portions 15 project, is provided with a greater quantity of lubricating oil. As a result, lubricating oil is better able to pass from the slide bearings for mounting the camshaft 1 in the cylinder head via the exposed groove portions 15 and into the oil channeling grooves 14 through a migration of the lubricating oil on the outer surface 13 of the outer shaft 10.

Figure 7:
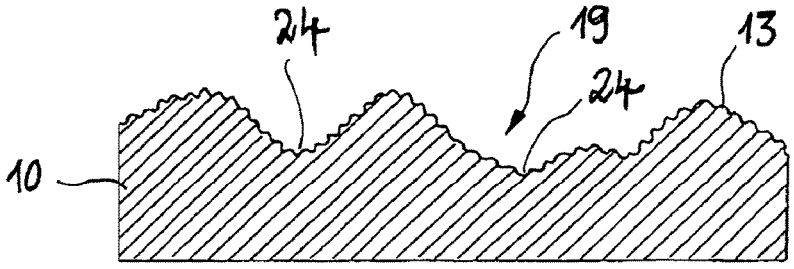
FIG. 7 is a cross-sectional view of an example outer surface of an outer shaft with surface texturing.
Figure 8:
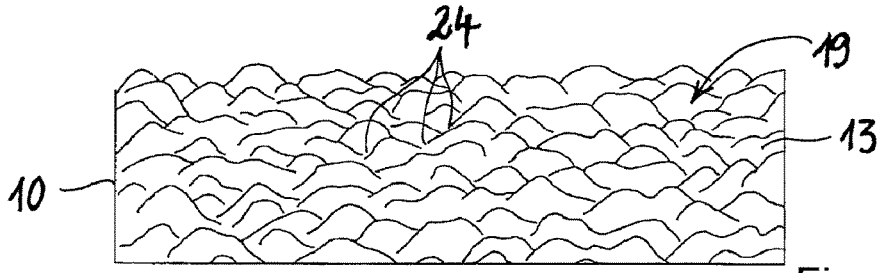
FIG. 8 is a perspective view of an example outer surface of an outer shaft with surface texturing.

FIGS. 7 and 8 in a cross sectional view (FIG. 7) and in a diagrammatic perspective view (FIG. 8) show the outer surface 13 of the outer shaft 10 having a surface texturing 19. The surface texturing 19 may be made in the outer surface 13 of the outer shaft 10, but also in the inner surface of the cam bore, for example by a laser beam machining process, a honing process, an electron beam process or by an etching process, producing micro-cavities 24 in particular. By producing micro cavities 24 in the outer surface 13 the adherence of the lubricating oil on the outer surface 13 is improved and the lubricating film between the outer surface 13 of the outer shaft 10 and the cam bore in the cam element 12 is stabilized.

Figure 9:
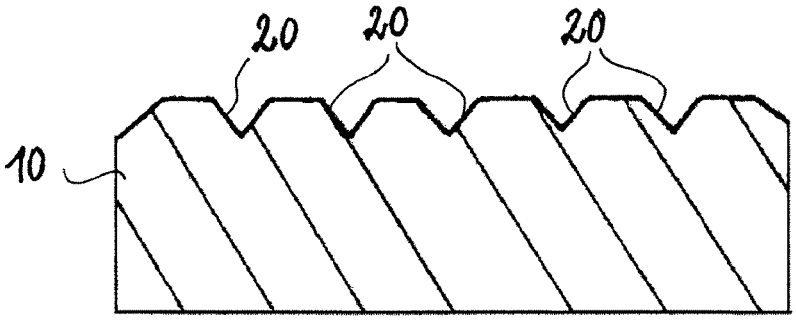
FIG. 9 is a cross-sectional view of an example outer surface of an outer shaft with surface texturing.

FIG. 9 shows other forms of surface texturing 20 in the shape of channels, which are shown in the cross section of the outer shaft 10. The channels 20 may be made in the surface, for example by a cutting production process, for example by a honing process.

Figure 10:
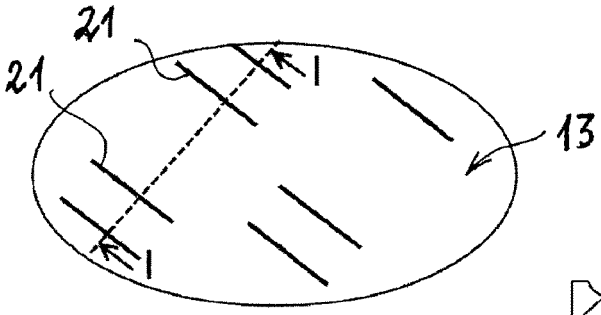
FIG. 10 is a top view of an example outer surface of an outer shaft with surface texturing.
Figure 10A:
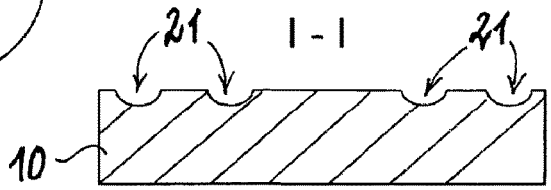
FIG. 10*a* is a cross-sectional view of the example outer surface of FIG. 10.

FIG. 10 by way of example shows a diagram of the outer surface 13 with surface texturing 21 introduced into this, the texturings in FIG. 10*a* being represented along the line of section I to I. The surface texturing 21 has a semicircular cavity and extends longitudinally over portions of the outer surface 13. Such surface texturing 21, too, can be made in the outer surface 13 by laser beam machining processes, honing processes, electron beam processes or by etching processes and likewise serve to form micro lubricating oil reservoirs, in order to store a quantity of lubricating oil for lubrication of the slide bearing gap. The surface texturings 19, in a manner not shown, may cross the oil channeling grooves 14 in the outer surface 13 or may be arranged adjacent to these, so that lubricating oil is able to pass from the oil channeling grooves 14 into the surface texturings 21.

In its performance the invention is not limited to the preferred exemplary embodiments specified above, a number of variants instead being feasible, which make use of the solution presented even in embodiments of fundamentally different type. All features and/or advantages following from the claims, the description or the drawings, including design details or spatial arrangements, may be essential for the invention both in themselves and in a variety of combinations.

What is claimed is:

1. An adjustable camshaft for a valve drive of an internal combustion engine, the adjustable camshaft comprising:

an outer shaft having a longitudinal axis;

an inner shaft concentric with the outer shaft and rotatably supported in the outer shaft;

a cam element with a cam bore rotatably supported on an outer surface of the outer shaft so as to form a slide bearing gap between the cam element and the outer shaft, the slide bearing gap occupying an axial length of the camshaft, the cam element being rotatably fixed to the inner shaft; and an oil channeling groove disposed in the outer surface of the outer shaft, the oil channeling groove extending over at least part of the axial length occupied by the slide bearing gap, the oil channeling groove having a first end at a first point and a second end at a second point and defining a continuous line from the first end to the second end, each point along the continuous line having a single tangent line that is non-perpendicular to the longitudinal axis of the outer shaft, the oil channeling groove having an exposed groove portion such that the first end extends axially beyond a side of the cam element.

2. The adjustable camshaft of claim 1, wherein the oil channeling groove is either:

(a) helical; or (b) linear, extending generally parallel to the longitudinal axis of the outer shaft.

3. The adjustable camshaft of claim 1, wherein the oil channeling groove is linear and extends generally parallel to the longitudinal axis of the outer shaft.

4. The adjustable camshaft of claim 1, wherein the oil channeling groove is helical.

5. The adjustable camshaft of claim 4, further comprising a second oil channeling groove disposed in the outer surface of the outer shaft wherein the oil channeling groove extends in a first helical direction and the second oil channeling groove extends in a second helical direction generally opposite the first helical direction.

6. The adjustable camshaft of claim 1, further comprising a bolt extending transversely through the inner shaft and through a bolt aperture in the outer shaft, wherein an end of the bolt is seated in the cam element, wherein the inner shaft is rotatably fixed to the cam element by the bolt, wherein the oil channeling groove is spaced apart from the bolt aperture.

7. The adjustable camshaft of claim 1, wherein the cam element comprises a cam flange, wherein the slide bearing gap is disposed at least between the cam flange and the outer surface of the outer shaft.

8. The adjustable camshaft of claim 1, wherein a cross-section of the oil channeling groove varies across a length of the oil channeling groove, wherein a portion of the oil channeling groove disposed beneath the cam element is tapered relative to the exposed groove portion.

9. The adjustable camshaft of claim 1, further comprising:

a surface texturing disposed on the outer surface of the outer shaft; and a lubricating film disposed between the outer surface of the outer shaft and an inner surface of the cam bore;

wherein the surface texturing improves a load-carrying capacity of the lubricating film relative to an outer surface without the surface texturing.

10. The adjustable camshaft of claim 1, further comprising:

a surface texturing disposed on at least one item selected from the group consisting of an inner surface of the cam bore and the outer surface of the outer shaft; and a lubricating film disposed between the outer surface of the outer shaft and the inner surface of the cam bore;

wherein the surface texturing improves a load-carrying capacity of the lubricating film relative to a surface without the surface texturing.

11. The adjustable camshaft of claim 10, wherein the surface texturing is produced by a laser beam machining process, a honing process, an electron beam process, or an etching process.

12. The adjustable camshaft of claim 11, wherein the surface texturing is oriented axially, circumferentially, spirally, or in a reticulating manner relative to the longitudinal axis of the outer shaft.

13. The adjustable camshaft of claim 1, further comprising a surface texturing disposed on at least one item selected from the group consisting of an inner surface of the cam bore and the outer surface of the outer shaft; wherein the surface texturing is produced by a laser beam machining process, a honing process, an electron beam process, or an etching process.

14. The adjustable camshaft of claim 13, wherein the surface texturing is oriented axially, circumferentially, spirally, or in a reticulating manner relative to the longitudinal axis of the outer shaft.

15. The adjustable camshaft of claim 1, wherein the oil channeling groove extends over the entire axial length occupied by the slide bearing gap, and wherein the second end of the oil channeling groove extends axially beyond another side of the cam element.

16. The adjustable camshaft of claim 1, further comprising a second oil channeling groove disposed in the outer surface of the outer shaft.

17. An adjustable camshaft, comprising:

an inner shaft and an outer shaft, the inner shaft being rotatably supported in the outer shaft and concentric with the outer shaft about a longitudinal axis;

a cam rotatably supported on the outer shaft such that the outer shaft extends through a cam bore of the cam;

a bolt for rotatably fixing the cam to the inner shaft; and an oil channeling groove disposed in an outer surface of the outer shaft, the oil channeling groove extending over at least part of an axial length of the outer surface of the outer shaft occupied by the cam, the oil channeling groove having a first end at a first end point and a second end at a second end point and defining a continuous line from the first end to the second end, each point along the continuous line having a single tangent line that is non-perpendicular to the longitudinal axis of the outer shaft, the oil channeling groove extending axially beyond the cam to form an exposed groove portion.

18. The adjustable camshaft of claim 17, further comprising a surface texturing disposed on at least one item selected from the group consisting of an inner surface of the cam bore and the outer surface of the outer shaft; wherein the surface texturing is produced by a laser beam machining process, a honing process, an electron beam process, or an etching process.

19. The adjustable camshaft of claim 17, further comprising a second oil channeling groove disposed in the outer surface of the outer shaft.

20. An adjustable camshaft for a valve drive of an internal combustion engine, the adjustable camshaft comprising:

an outer shaft having a longitudinal axis;

an inner shaft concentric with the outer shaft and rotatably supported in the outer shaft;

a cam element with a cam bore rotatably supported on an outer surface of the outer shaft so as to form a slide bearing gap between the cam element and the outer shaft, the slide bearing gap occupying an axial length of the camshaft, the cam element being rotatably fixed to the inner shaft; and an oil channeling groove disposed in the outer surface of the outer shaft, the oil channeling groove extending over at least part of the axial length occupied by the slide bearing gap, the oil channeling groove having a first end at a first point and a second end at a second point and defining a continuous line from the first end to the second end, each point along the continuous line having a single tangent line that is non-perpendicular to the longitudinal axis of the outer shaft, the oil channeling groove having an exposed groove portion such that a side of the cam element is between the first and second ends of the oil channeling groove.

* * * * *